US006312701B1

(12) United States Patent
Bauer et al.

(10) Patent No.: US 6,312,701 B1
(45) Date of Patent: Nov. 6, 2001

(54) PELARGONIC ACID VANILLYAMIDE CONTAINING TEAR GAS

(75) Inventors: Eran Nicodemus Bauer; Penelope Jane Bauer; Gerard Miet Bauer, all of Lincoln (GB); Felix Muser, Riedbodelistrasse 1, CH-8834 Schindeliegl; Renato Salvel, Zurich, both of (CH)

(73) Assignees: Eran N. Bauer; Penelope J. Bauer; Gerard M. Bauer, all of (GB); Felix Muser; Alexander Mader, both of (CH)

( * ) Notice: Subject to any disclaimer, the term of this patent is extended or adjusted under 35 U.S.C. 154(b) by 0 days.

(21) Appl. No.: 09/424,415

(22) PCT Filed: May 22, 1998

(86) PCT No.: PCT/GB98/01511

§ 371 Date: Nov. 23, 1999

§ 102(e) Date: Nov. 23, 1999

(87) PCT Pub. No.: WO98/52884

PCT Pub. Date: Nov. 26, 1998

(30) Foreign Application Priority Data

May 23, 1997 (GB) ..... 9710636

(51) Int. Cl.[7] ..... A61K 9/00; A61K 9/12; A61K 9/14; A61L 9/14

(52) U.S. Cl. ..... 424/400; 424/40; 424/43; 424/44; 424/45; 424/484

(58) Field of Search ..... 424/45, 43, 195.1, 424/40, 44, 401, 484

(56) References Cited

U.S. PATENT DOCUMENTS 5,500,205 * 3/1996 Abbott et al. ..... 424/401

* cited by examiner

*Primary Examiner*—Shelley A. Dodson
(74) *Attorney, Agent, or Firm*—Jackson Walker L.L.P.

(57) ABSTRACT

The invention relates to an incapacitant mixture comprising PAVA and a solvent, wherein the mixture capable of inducing temporary blindness in a human or animal. The mixture comprises less than 5 per cent PAVA and a solvent.

17 Claims, No Drawings

PELARGONIC ACID VANILLYAMIDE CONTAINING TEAR GAS

FIELD OF THE INVENTION

This invention relates to incapacitants, and in particular to incapacitant sprays used in law enforcement.

BACKGROUND TO THE INVENTION

Incapacitants such as CS, Oleoresin Capsicum (OC), and CN gas are widely used in law enforcement, for military purposes, and by individuals for their own personal security.

Known incapacitants have drawbacks. For instance CS does not always incapacitate the person on which it is used. If the person has been taking drugs the CS may actually make him more violent, OC incapacitant, more commonly known as pepper spray creates undesirable eye, lung and skin effects. In particular OC is known to be a carcinogen.

Oleoresin Capsicum pepper extract is a brown sticky substance, and when mixed with solvents it forms a brown liquid. This brown liquid can mark skin and clothing.

Apart from the problems inherent in the product, known incapacitants also cause operational problems. The incapacitant on an assailant who has been sprayed with an incapacitant may cross contaminate other people, including the very officers who are trying to control him. Clearly this is disadvantageous.

An example of a known incapacitant is disclosed in JP 49035198 B4, where a mixture comprising nonylic acid vannillylamide, ammonia and red pepper combine to provide for the inducement of lachrymatory and sneezing effects.

Known incapacitants affect the respiratory system of those people on which they are used. If a person has a respiratory problem, using an incapacitant on him may pose a serious health risk. Of course, the sprayer of the incapacitant does not know the medical condition of the person he is spraying. The result is that there is a small risk of an incapacitant which is designed to be non-lethal being potentially lethal for some people. Clearly it is most undesirable, from both a social and a financial point of view, to cause death unnecessarily.

Despite the disadvantages of the many known incapacitants, a significant number of countries have taken the view that the risk of death and injury both to assailants and those using the incapacitants is worth taking, given the ever increasing use of violence in today's society.

It would therefore be desirable to provide an improved incapacitant for use by police forces, peace-keeping forces, the military and also personal use.

SUMMARY OF THE INVENTION

The invention provides an incapacitant mixture comprising pelargonic acid vanillylamide capable of inducing temporary blindness in a human or animal.

Hereinafter in this application pelargonic acid vanillylamide shall be referred to as PAVA.

Preferably, the mixture comprises a solvent.

Preferably the mixture is capable of inducing temporary blindness in a human, and more preferably the mixture of the invention is capable of inducing blindness in a human for more than 5 minutes.

The invention provides a mixture suitable for incapacitating a human or an animal, comprising PAVA, wherein application of the said mixture does not cause injury to the skin or mucus membrane of the said human or animal.

The invention provides an incapacitant mixture comprising less than 5 per cent PAVA and a solvent.

Preferably, the proportion of PAVA in the mixture is 1 per cent or less. More preferably, the proportion of PAVA in the mixture is 0.65 per cent or less. Still more preferably, the proportion of PAVA is between 0.01 and 0.65 per cent.

Any suitable solvent may be used, and the solvent may comprise one more of the group comprising ethanol, water, isopropyl alcohol, methylchloride, and methylalcohol.

The incapacitant component in the mixture may consist of PAVA. Alternatively, the incapacitant component in the mixture may comprise PAVA and other incapacitants such as CS, OC, or CN. Advantageously, the primary incapacitant component in the mixture is PAVA.

The mixture may comprise a dye or a marker.

One embodiment of the invention provides an incapacitant spray comprising a means for storing and delivering an incapacitant mixture according to the invention.

The storing means may be a can.

The delivery means may be an aerosol, the mixture of the invention comprising an aerosol propellant, such as nitrogen, carbon dioxide, or Forane 134a. Alternatively, the delivery means may use pressurised air to expel the mixture of the invention from the storing means.

In one embodiment of the invention there is provided an incapacitant mixture comprising 0.64 percent PAVA, a solvent being 50 per cent water and 50 percent isopropylalcohol, and a propellant therefor, the said propellant being carbon dioxide.

In another embodiment of the invention there is provided an incapacitant mixture comprising 0.01 percent PAVA, 3 percent alcohol, which alcohol may be isopropyl alcohol, and 96.99 percent water.

The provision of alcohol in the mixture aids the solubility of the PAVA in the mixture, and ensures that the liquid can flow through the nozzle of a delivery device such as an aerosol.

The mixture of the invention does not have any significant effect on the respiratory system, yet causes temporary blindness which is exceptionally effective in incapacitating humans. The person must be incapacitated during the journey to a police station for instance until he is locked in a cell. A person may be dosed repeatedly with the incapacitant of the invention, in order to keep him under control when the effects of one application begin to wear off. However, it is important for the person to recover quickly, so that interviewing can take place. It is therefore of great advantage to be able to control with accuracy the time for which a person is incapacitated. Furthermore, there is no need to provide skin and eye washes for the person who has been sprayed, or to give him fluid or access to fresh air. Hence, the cost of dealing with a person who has been incapacitated with an incapacitant according to the invention is much less than one who has been incapacitated with a known incapacitant.

The PAVA, which is the active ingredient in the mixture, is in the form of a liquid rather than a powder or crystals as with most other incapacitants. This reduces the risk of cross contamination. Furthermore, PAVA oxidises very quickly upon contact with air, and this further reduces the cross contamination effects of the mixture of the invention.

The incapacitant mixture of the invention has a lower concentration of active ingredient than known incapacitants but is nevertheless effective in incapacitating individuals.

EXAMPLES

In the examples, PAVA classified under CAS No. 244-46-4 was used.

1) An incapacitant according to the invention having 0.1 per cent PAVA, a solvent comprising 50 per cent water and 50 per cent isopropanol, and carbon dioxide as a propellant was prepared.

The incapacitant was sprayed at a person in the region of the eyes. The incapacitant caused irritation of the eyes and connected with that profuse eye watering, thereby incapacitating the said person. The incapacitant posed no health risk insofar as the skin, mucus membranes and eyes were not damaged. The incapacitant induced blindness for up to eight minutes.

2) An incapacitant according to the invention having 0.01 per cent PAVA, a solvent comprising 50 per cent water and 50 per cent ethanol, and air as a propellant was prepared.

The incapacitant was sprayed at a person in the region of the eyes. The incapacitant caused irritation of the eyes and connected with that profuse eye watering, thereby incapacitating the said person. The incapacitant posed no health risk insofar as the skin, mucus membranes and eyes were not damaged. The incapacitant induced blindness again for up to eight minutes.

With a concentration of 0.01 per cent of PAVA there is less skin reddening than with a concentration of 0.1 per cent PAVA.

3) An incapacitant according to the invention having 0.01 percent PAVA, 3 percent isopropyl alcohol and 96.99 percent water was prepared. Air was used to propel the mixture from an aerosol.

The amount of alcohol used in example 3 was less than in example 2, but mixture could nevertheless be sprayed satisfactorily through the nozzle of the aerosol.

The effect of increasing the proportion of PAVA is to induce irritant effects. Where the concentration of PAVA exceeds 5 per cent, the irritant effects are such that damage to lungs, eyes and skin may occur.

The structures of Capsaicin and PAVA are very similar, and are shown below.

Capsaicin

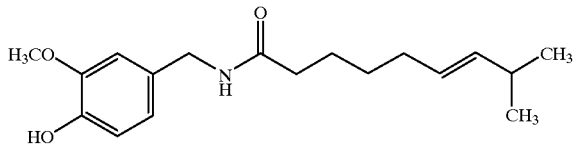

PAVA

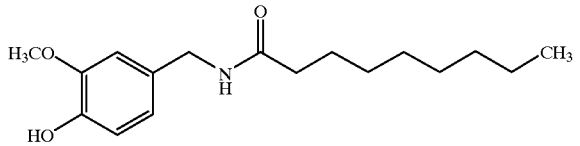

What is claimed is:

1. An incapacitant mixture comprising PAVA and a solvent, wherein the mixture is capable of inducing temporary blindness in a human or animal, and wherein PAVA is the primary incapacitant in the mixture, the proportion of PAVA in the mixture being 2.5% or less.

2. A mixture according to claim 1, wherein the proportion of PAVA in the mixture is 1% or less.

3. A mixture according to claim 1, wherein the proportion of PAVA in the mixture is 0.65% or less.

4. A mixture according to claim 1, wherein the proportion of PAVA is between 0.01 and 0.65%.

5. A mixture according to claim 1, wherein the solvent comprises one or more of the group comprising ethanol, water, isopropyl alcohol, methylchloride, and methylalcohol.

6. A mixture according to claim 1, wherein the incapacitant component in the mixture consists of PAVA.

7. A mixture according to claim 1, wherein the mixture comprises PAVA as the primary incapacitant component in the mixture, and at least one additional incapacitant.

8. A mixture according to claim 7, wherein the at least one additional incapacitant is chosen from the group comprising CS, OC, or CN.

9. A mixture according to claim 1, further comprising a marker.

10. A mixture according to claim 4, comprising 0.64% PAVA, said solvent comprising 50% water and 50% isopropylalcohol.

11. A mixture according to claim 4, comprising 0.01% PAVA, said solvent comprising 3% alcohol, and 96.99% water.

12. A mixture according to claim 11, wherein the alcohol is isopropyl alcohol.

13. An incapacitant spray comprising an incapacitant mixture comprising PAVA and a solvent, wherein the mixture is capable of inducing temporary blindness in a human or animal, and wherein PAVA is the primary incapacitant in the mixture, the proportion of PAVA in the mixture being 5% or less, a storing and delivery means, and a propellent.

14. An incapacitant spray according to claim 13, wherein the delivery means is an aerosol, an aerosol propellant being provided to expel the incapacitant mixture from the storing means.

15. An incapacitant spray according to claim 14, wherein the propellant is chosen from the group comprising nitrogen, carbon dioxide, and forane.

16. An incapacitant spray according to claim 13, wherein the delivery means comprises a source of pressurized air to expel the mixture from the storing means.

17. An incapicitant spray according to claim 13, wherein the storing means is a canister.

* * * * *